United States Patent [19]

Pietsch

[11] 4,033,559

[45] July 5, 1977

[54] APPARATUS FOR CONTINUOUS PASSIVATION OF SPONGE IRON MATERIAL

[75] Inventor: Wolfgang B. Pietsch, Matthews, N.C.

[73] Assignee: Midrex Corporation, Charlotte, N.C.

[22] Filed: Apr. 5, 1976

[21] Appl. No.: 673,787

Related U.S. Application Data

[62] Division of Ser. No. 584,184, June 5, 1975.

[52] U.S. Cl. ..... 266/122; 75/.5 BA

[51] Int. Cl.² ..... C22B 1/26

[58] Field of Search ..... 29/420.5; 75/.5 BA, 75/3; 83/408; 100/39, 94.4, 94.5; 266/103, 122, 137, 173, 176, 183, 901

[56] References Cited

UNITED STATES PATENTS

| | | | |
|---|---|---|---|
| 2,150,984 | 3/1939 | Near et al. | 266/137 X |
| 2,922,223 | 1/1960 | Boughton et al. | 29/420.5 |
| 3,125,437 | 3/1964 | Moore et al. | 75/3 |
| 3,389,993 | 6/1968 | Lund et al. | 29/420.5 X |
| 3,458,927 | 8/1969 | Wiechec | 29/420.5 X |
| 3,650,168 | 3/1972 | Ruschmann | 83/408 X |
| 3,862,594 | 1/1975 | Stölting et al. | 100/95 |

FOREIGN PATENTS OR APPLICATIONS

| | | | |
|---|---|---|---|
| 1,533,827 | 10/1971 | Germany | 266/137 |

*Primary Examiner*—Roy Lake
*Assistant Examiner*—Paul A. Bell
*Attorney, Agent, or Firm*—Ralph H. Dougherty

[57] ABSTRACT

Apparatus for continuous passivation of hot sponge iron material consists of a feeder, a roll compactor for forming a high density continuous elongated mass, and longitudinal and transverse shearing devices, along with the requisite control and transporting mechanisms.

15 Claims, 12 Drawing Figures

VI
VI
16
18
100
100
88
24
22
92
26
102
12
104
104

100
100
100
102
24
92
22
22
92
104
104

APPARATUS FOR CONTINUOUS PASSIVATION OF SPONGE IRON MATERIAL

This is a division, of application Ser. No. 584,184, filed June 5, 1975.

BACKGROUND OF THE INVENTION

Sponge iron, metallized pellets or reduced metal materials are produced by the direct reduction of ores. "Metallized" in this sense does not mean coated with metal, but means nearly completely reduced to metal, i.e., always in excess of 75% metal, and normally in excess of 85% metal in the product. This metallized product is suitable for charging directly to a metal refining furnace as the feed material. In ferrous metallurgy, the product referred to is metallized iron material, which is charged directly to a steelmaking furnace, such as an electric arc furnace. Steel plants which utilize metallized iron as feed material have no need for metallurgical coal or coke. Further, such plants are economical at small capacities and thus do not require the high capital investment of plants which employ blast furnace.

One of the problems associated with the use of sponge iron as a raw material in steelmaking is its inherent tendency to reoxidize upon exposure to atmospheric conditions. Hot sponge iron is extremely reactive and oxidizes spontaneously if contacted by oxygen in any form. Thus, sponge iron must be cooled in a reducing or neutral atmosphere. At room temperature, sponge iron is so reactive that it oxidizes even when stored in the open air. Contact with water, likewise, causes rapid oxidation, which is commonly termed rusting. Since the oxidation of sponge iron is an exothermic reaction, this oxidation can result in spontaneous heating and ignition of the sponge iron during storage or transport. For this reason, metallized sponge iron has been classified a hazardous material by the U.S. Coast Guard, and its bulk shipment in the unstabilized condition is prohibited.

In some instances, reduced iron in such form as sponge iron or metallized iron pellets is produced in an integrated steel plant as a raw material for the steelmaking furnaces. If it were possible to feed the hot reduced iron, at a temperature above 500° C (about 930° F), directly into the steelmaking furnace, this would result in a more economical steelmaking process, inasmuch as the energy requirements would be greatly reduced and higher productivity would be obtained. It would be imperative that hot sponge iron material be transported and handled in a controlled atmosphere, as exposure to atmospheric air would result in an extremely hazardous situation. If the hot sponge iron could be passivated sufficiently that it could be transported by conventional equipment with a minimal heat loss, the steelmaking process for which it serves as a raw material could realize the full benefit of its heat content with attendant savings in energy consumption.

Passivation of sponge iron is also desirable because oxidation of sponge iron, after having once been reduced, requires a second reduction with an attendant increase in energy consumption and cost.

Many attempts have been made in the past to overcome, or reduce, the reoxidation of metallized pellets and to passivate sponge iron. Illustrative examples include the proposal to cover a bulk shipment of sponge iron with a thin polyurethane foam coating or other type of plastic film to prevent oxygen or moisture from contacting the sponge iron. It has also been suggested to cover such a bulk shipment with a thin glass coating. U.S. Pat. No. 3 125 437 teaches a process for passivating sponge iron against oxidation in air by creating a thin protective skin on the sponge iron surface. Hot briquetting with roll type briquetting machinery are taught in U.S. Pat. Nos. 3 116 996 and 3 174 846 to densify the sponge iron, thereby minimizing the surface area of the reduced iron ore exposed to the oxidizing elements. These illustrative, but not exhaustive examples demonstrate the many attempts to solve the problem.

Coatings on sponge iron require the use of a foreign material which contaminates sponge iron without guaranteeing passivation. Such coatings are easily damaged, for instance, a mere shifting of the material in its container during transit may rupture the coating. Although a protective oxide skin is a proven inhibitor to oxidation in air, it is subject to rusting to hydrated ferric oxide. Thus, such skin does not prevent further oxidation by rusting.

Heretofore, the hot briquetting of sponge iron has been a very promising process for passivation inasmuch as it can be used to passivate bulk shipments to a high degree, as well as to passivate hot sponge iron with temperatures as high as 900° C (about 1650° F), so that it can be transported on conventional hot conveying systems at high temperature without either a prohibitively high loss of metallization or spontaneous ignition. Densification of sponge iron, at least on its surface, is accomplished by hot briquetting. The exterior of the briquet is compressed to a dense layer which is stable or passivated. The interior of the briquet remains less dense, i.e., spongy, and thus is active and readily oxidized, but is protected by the more dense surface layer.

Hot briquetting encounters certain mechanical problems. Before the briquetting rolls start to wear, single briquets are easily produced. As soon as wear begins, briquets become connected to each other by webs, which requires that they be broken apart prior to shipment or handling. As roll wear increases, the problem of breaking the briquets apart becomes more and more difficult. In addition, the breaking procedure produces fines and exposes the less densified interior of each briquet to oxidation, particularly if the breakage occurs through the briquet rather than through the web. With increasing web thickness due to increasing wear, this occurs more and more frequently. Thus, although the greater proportion of each briquet is passivated, there is still a sufficient proportion of the briquet which is less passivated and subject to reoxidation with a high loss of metallization.

For known strip breaking mechanisms, see German Pat. No. 1, 533,827.

OBJECTS OF THE INVENTION

It is the general object of this invention to avoid and overcome the foregoing and other difficulties of and objections to prior practices by the provision of an apparatus for continuously passivating metallic materials which are highly reactive because of their high porosity and the high specific surface area associated therewith.

It is a more specific object of this invention to provide a simplified and efficient apparatus for the passivation of sponge iron.

It is also an object of this invention to provide a means for producing passivated material having consistently high quality.

It is a further object of this invention to provide a means for passivating sponge iron produced by a direct reduction plant which apparatus requires little maintenance.

It is also an object of this invention to provide means for passivating sponge iron which has a low operating cost.

It is also an object of this invention to provide means for preventing oxidation of reduced metal during the compaction step.

It is another object to provide means for passivating sponge iron by forming a multiplicity of dense elongated strips then shearing them into small, compact, easily handled pieces.

It is also an object to provide means for simultaneously cutting and compacting a compacted mass.

It is another object to provide a method for compacting sponge iron which utilizes entrained reducing gas to form a protective, non-oxidizing atmosphere in the compaction region.

It is another object to provide means for controlling the rate of feed of particulate metal to the compacting apparatus.

It is another object of this invention to provide a system for continuously passivating hot sponge iron in which the hot product can be directly transported to a steelmaking furnace at high temperatures whereby the retained inherent heat will reduce the required energy input for melting the sponge iron in the steelmaking process.

BRIEF SUMMARY OF THE INVENTION

The aforesaid objects of this invention, and other objects which will become apparent at this description proceeds, are achieved by providing hot sponge iron compacting apparatus followed by a shearing apparatus. The hot compacting apparatus rolls the sponge iron into an elongated mass. The shearing apparatus cuts the mass across its longitudinal dimension, compacting the newly exposed edges, and creating small "compacts" which are easily handled, transported, and used in subsequent processes.

Where the compacting apparatus produces a relatively wide strip, apparatus may be provided for slitting the elongated mass longitudinally to produce a plurality of elongated masses.

While this invention is described in terms of sponge iron, it will be readily understood by those skilled in the art that the invention is equally applicable to the compaction of metallized iron material in other forms such as pellets or fines, as well as other metals which have been directly reduced from their oxides, or ores, and which metals react in the same manner as and have comparable properties to sponge iron under oxidizing conditions.

BRIEF DESCRIPTION OF THE DRAWINGS

For better understanding of this invention, reference should be had to the accomplanying drawings, wherein.

DETAILED DESCRIPTION

Figure 1:
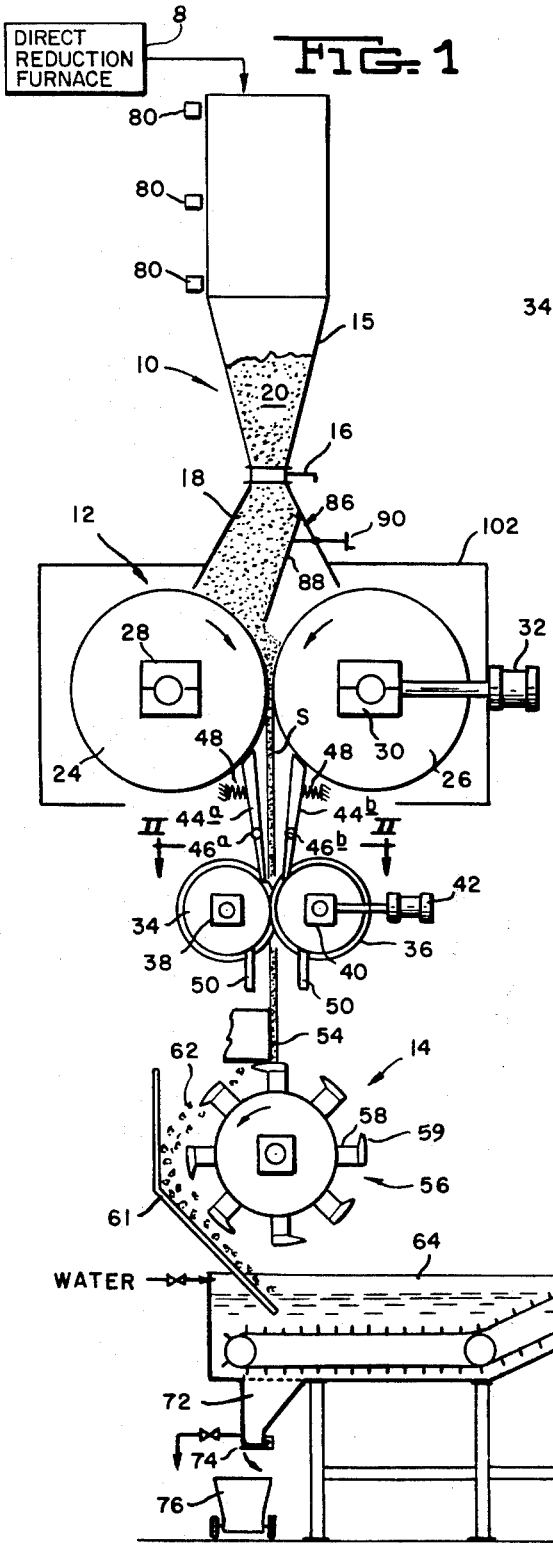
FIG. 1 is an elevational view of the preferred embodiment of my invention with some parts removed.

With specific reference to the form of the invention illustrated in the drawings and referring particularly to FIG. 1, apparatus for continuously passivating hot reactive particulate metal material consists essentially of three basic parts, a material accumulator 10, a compactor 12 and a divider-densifier 14.

Figure 5:
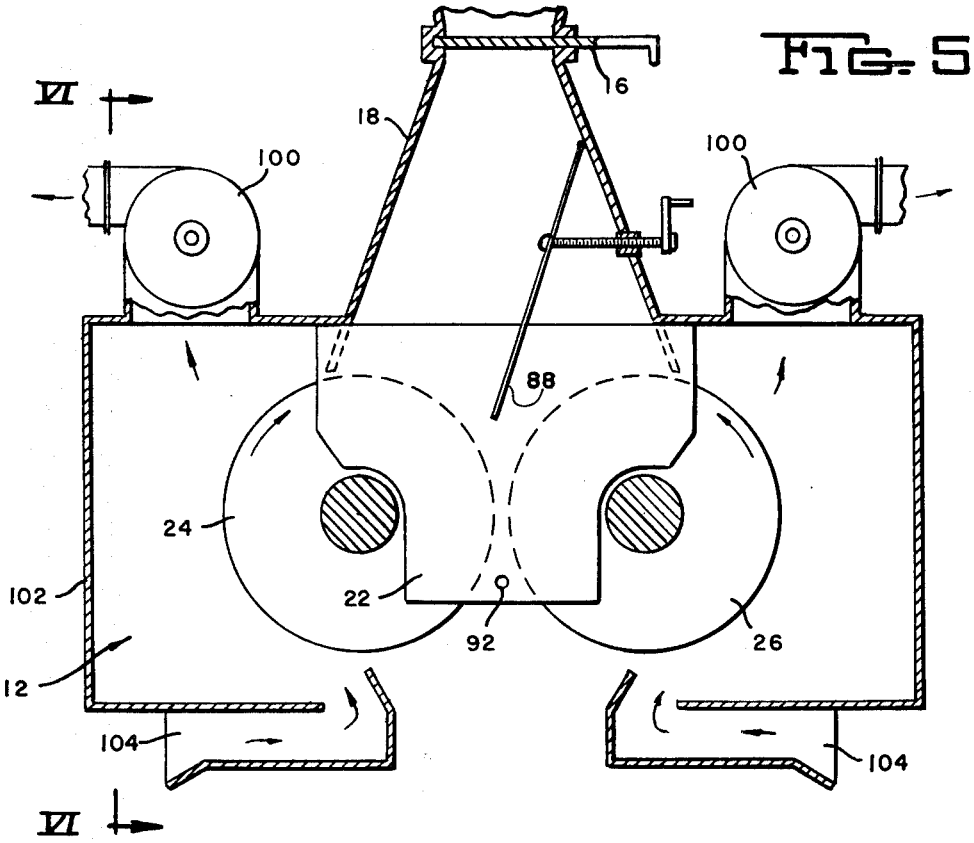
FIG. 5 is an end view of the compactor rolls and their associated parts.

Accumulator 10 may take the form of a surge bin 15 having a slide valve 16 at the bottom thereof positioned above a feed hopper 18, which hopper is adapted both to contain hot feed material 20 and to control the rate of feed of the material to the compactor apparatus 12. The feed material 20 may be sponge iron, pellets or lump ore, or a combination thereof, which material has been reduced in an associated direct reduction furnace 8. Feed hopper 18 includes cheek plates 22, shown in FIG. 5 and 15, which bear against the ends of the bodies of power driven, large diameter compactor rolls 24 and 26 to seal the interior of the hopper 18 against atmospheric air. As shown, roll 24 is fixed in its chocks 28 whereas roll 26 is movably mounted in horizontally movable roll chocks 30, the movement of which is controlled by hydraulic cylinders 32. Rolls 24 and 26 may have a flat contour or may have a small collar at each end of the roll body.

The region from slide valve 16 to the nip of rolls 24 and 26 is designated hereunder as the feeding and compaction zone.

Scrapers **44*a* and 44*b* are pivotally mounted beneath the compacting rolls at pivot points 46*a* and 46*b* respectively, each of which is well below the center of gravity of its respective scraper. Thus, the upper edge of each scraper tends to maintain contact with its respective compacting roll. A tension spring 48** biases each scraper against its compacting roll to ensure sure contact.

Figure 2:
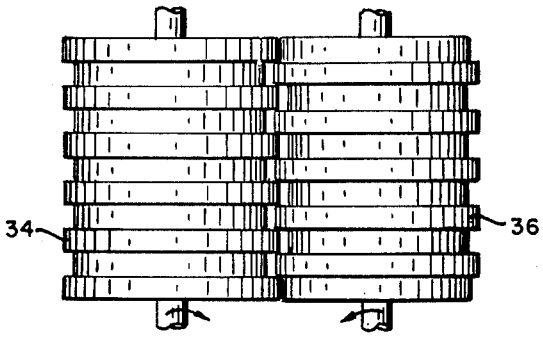
FIG. 2 is a plan view of a pair of slitter rolls showing their interfitting configuration.
Figure 3:
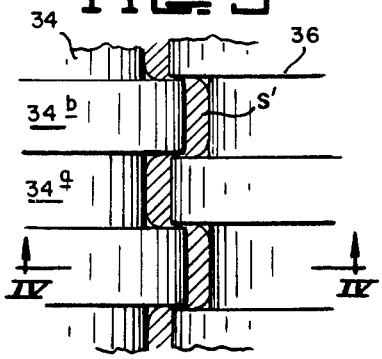
FIG. 3 is a plan view similar to FIG. 2 on a larger scale taken through the workpiece.

Beneath the compactor rolls and aligned with the pass-line thereof are a pair of horizontally opposed shearing or slitting rolls 34 and 36 for longitudinal slitting of wide strip. Roll 34 is mounted in fixed chocks 38 while roll 36 is mounted in horizontally movable chocks 40 the motion of which is controlled by hydraulic cylinders 42. The shearing rolls advantageously have a configuration as shown in FIGS. 2 and 3.

A doctor device 50 which may also be known as a roll stripper or guide is located on the discharge side or bottom of each roll 34 and 36. Such a guide may have the full contour of the roll, extending completely across the roll body. Alternatively, the device may consist of a number of guides each of which fits into a recess 34*a* or onto a collar 34*b* (FIG. 3) of the roll, respectively.

Aligned with the pass-lines of the compactor rolls and the slitter rolls is anvil 54, which likewise may have a horizontal contour matching that of roll 34. A rotating shear 56, containing a number of blade holders 58 with their associated blades 59, is mounted beneath the anvil 54 in such manner that the shear blades transversely cut the workpieces by shearing them against the anvil. Blades 59 preferably have a flat shearing face 60. A feed chute 61 may be provided beneath the rotary shear to collect the metallized iron compacts 62 and direct them into a cooling tank 64 which is filled with water. An apron conveyor 66 removes the compacts from the cooling tank, transferring them to a belt conveyor 68 for transshipment to a stockpile 70. The small amount of fine material that may be produced by the shearing and abrasion of the compacts falls through the perforations in the apron conveyor and collects in a funnel 72 which has a lock valve 74 at its lower extremity. The funnel can be emptied into a trough car 76 periodically to remove the fines from system.

In operation, hot sponge iron, pellets and/or lump material, including fines, is charged into surge bin 15. Level control devices 80 (such as a C-E Invalco Nuclear Level Control manufactured by C-E Invalco Division of Combustion Engineering, Inc., Tulsa, Oklahoma, U.S.A.) may be interlocked with the speed control on the roll drives for rolls 24 and 26 to ensure sufficient volume of material to maintain a constant width of the elongated strips (FIG. 1).

The hot sponge iron has a temperature of at least 600° C preferably 700° to 800° C and an average metallization of at least about 75%, but normally at least 85%, and preferably at least 90% metallized. The hot sponge iron passes from the surge bin 15 through the region of the s lide valve 16 into feed hopper 18. The slide valve is in the open position during operation of the apparatus, and is closed only when the machinery in shut down. The feed hopper, slide valve and surge bin must be gas tight to prevent ambient air from contacting the hot, extremely reactive material. The flow rate of hot sponge iron to the nip of the two compacting rolls 24 and 26 may be controlled by a movable feed tongue mechanism 86. This controls the volume of sponge iron reaching the rolls, and thus the thickness and density of the strip produced by compaction. If too great a volume of material is fed into the rolls, they will open, producing a thicker strip having an unfavorable density distribution or gradient. The feed tongue 88 is pivotally attached to the feed hopper, and has an adjusting arm 90 which extends outside the hopper. The tongue may extend the full width of the hopper, or a number of narrower tongues may be employed.

Figure 1A:
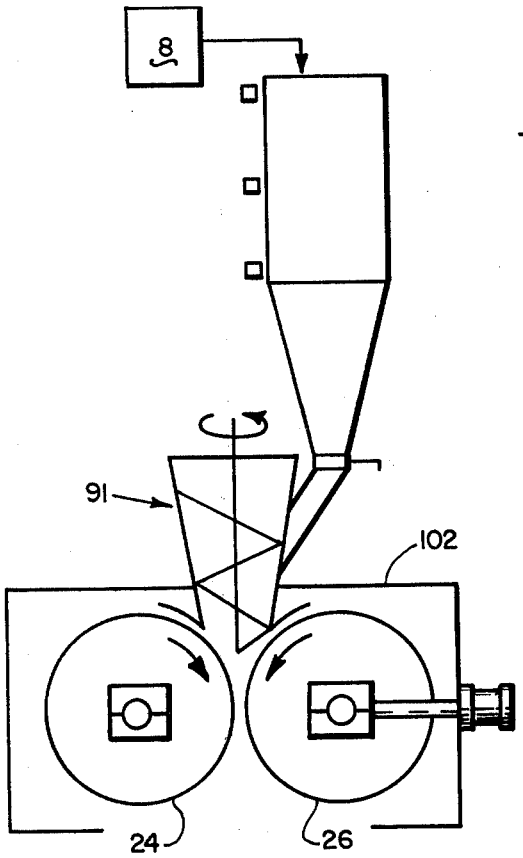
FIG. 1A is an elevational view of a modification to the feeder and feed hopper shown in FIG. 1.

Hot sponge iron is fed to the compacting rolls by gravity. An alternative feeder also shown in FIG. 1A arrangement such as a screw feeder may be used which will exert a position feed pressure on the material entering the roll nip. This will control both the rate and volume of flow of the feed material.

Figure 6:
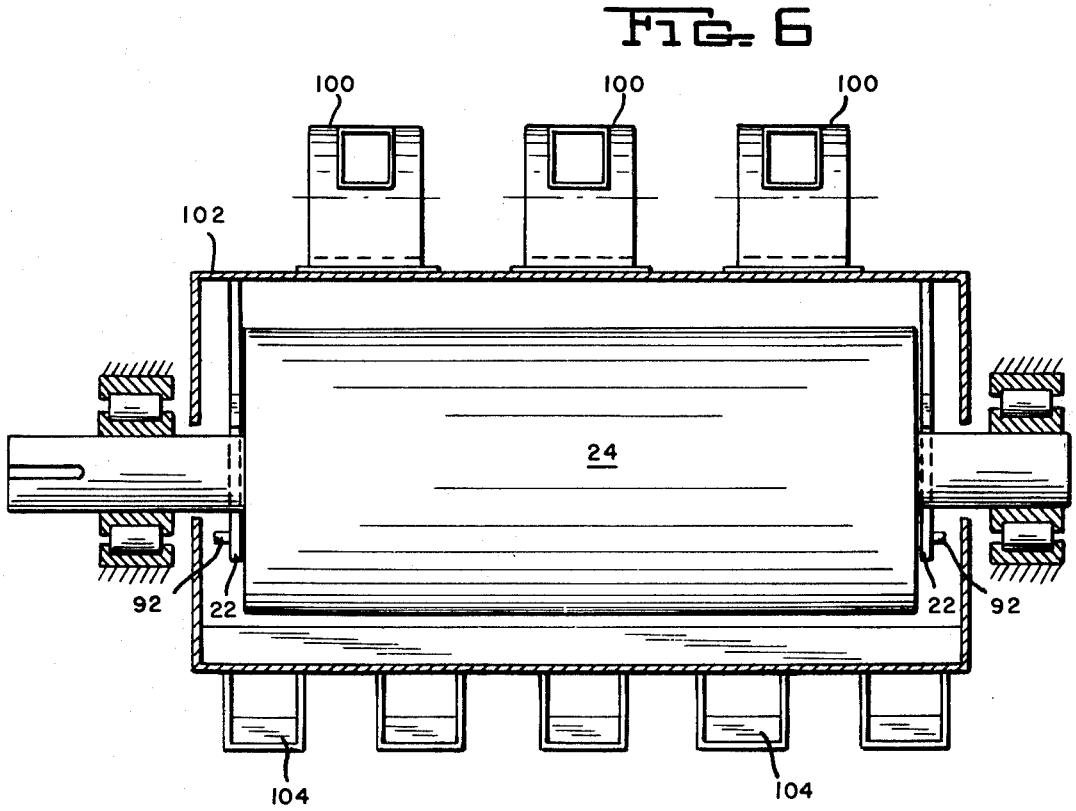
FIG. 6 is a sectional view taken along the line VI—VI of FIG. 5.

After entrainment of the hot sponge iron into the roll nip, the sponge iron is continuously densified by the counterrotating rolls 24 and 26 which exert large compressive forces on the sponge iron causing formation of an increasingly compacted iron mass until it reaches the narrowest gap at the horizontal centerline of the rolls. During this densification procedure, the individual pellets or lumps are deformed and the spongy structure of the iron is destroyed by the pressure of compaction exerted by the compacting rolls, and the fines are assimilated into the densified mass. The gas which has been in the interstices between the hot pellets as well as in the pores of the pellets, is forceably expelled therefrom and escapes from the hopper 18 through gaps between the ends of the compacting rolls and the cheek plates 22 as well as through gaps between the roll body and the base of feed hopper 18. This gas, which remained in and around the pellets on discharge from the direct reduction furnace 8 is reducing in character, and provides a steady stream of non-oxidizing gas to protect the feeding and compaction zone against contact by the surrounding atmospheric air. Thus it is unnecessary to provide a sophisticated sealing system. At startup a nitrogen purge is used. Nitrogen or other non-oxidizing gas is introduced to the feed hopper through orifice 92 (FIGS. 5 and 6) in the cheek plates 22 near the nip of the rolls. After a few feet of compacted strip has been formed, the nitrogen purge is stopped, as the reducing gas forced out of the pores will displace the nitrogen and maintain a reducing atmosphere.

Compaction of the hot sponge iron forms a continuous strip or sheet S (FIG. 1) having such high density that the formerly very high affinity of the iron for oxygen is so far reduced that it is no longer subject to catastrophic reoxidation. In fact oxidation of the surface of this extremely dense material will now result in a very small loss of metallization.

The means density of the strip depends on the thickness of the strip. A pronounced density gradient toward the less dense center of the strip reduces the mean density with increasing strip thickness. The mean density must be at least 4.5 grams per cubic centimeter, and preferably should be between 5 and 6 grams per cubic centimeter. Below a density of 4.5 grams per cubic centimeter, passivation is insufficient for long-term open bulk storage withouut significant loss of metallization. Note that while the mean density of a thick strip may be only 4.5, the surface contacted by the surrounding atmosphere has a very high density with an attendant high degree of passivation.

During compaction, the compacting rolls 24 and 26 become heated due to conduction of heat from the hot feed material 20, the temperature of which has been increased by the extremely great amount of energy input that has been transformed into heat and is absorbed by the feed material. Exhaust fans 100 (FIGS. 5 and 6) may be employed to remove excess heat from the rolls. For the exhaust fans to work efficiently, the compacting rolls 24 and 26 should be surrounded by an enclosure 102 best shown in FIG. 5. Enclosure 102 has at least one, but preferably a multiplicity of air intakes 104 along each side of its bottom face. The suction created by exhaust fans 100 will circulate ambient air through intakes 104 around compacting rolls 24 and 26 and out of enclosure 102 through the exhaust fans 100. These fans may be associated with a dust collector, bag house or precipitator to remove particulate material from the exhaust air.

Scrapers 44 act as roll guides for the compacting rolls 24 and 26 to prevent the elongated strip from wrapping around one of the rolls. In addition the scrapers assist in guiding the strip into the slitting rolls 34 and 36. The scrapers 44 are biased against the compacting rolls by springs 48 and guide the strip into the pass-line of the slitting rolls.

Figure 4:
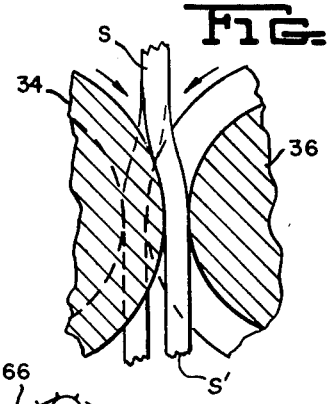
FIG. 4 is a sectional view taken along the line IV—IV of FIG. 3.
Figure 7:
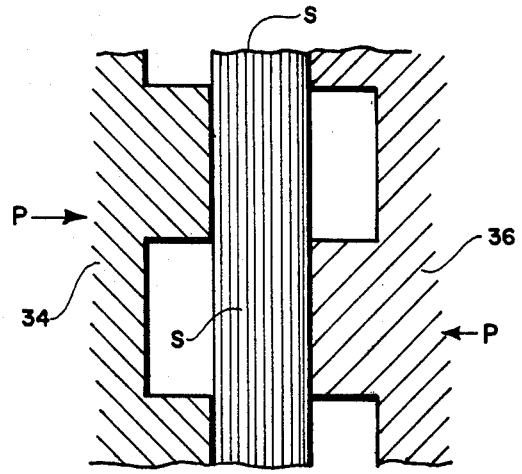
FIG. 7 is a schematic cross-sectional view of a workpiece about to be sheared longitudinally.
Figure 8:
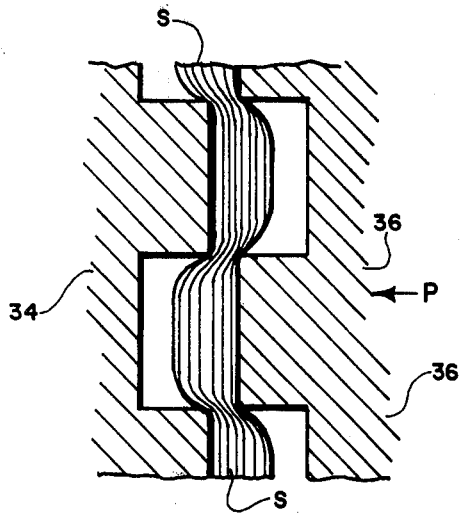
FIG. 8 is a schematic view of a workpiece undergoing longitudinal shearing and concomitant densification of its sheared edges.

Since the workpiece is a wide strip A upon exiting the densification rolls, it is cut into narrower S' strips (FIG. 4) by the roll slitter 34, 36 which forces the hot, highly malleable strip S into the alternating grooves in each roll. This process creates sufficient compressive forces on the edges of the newly slit strips S' to increase the density of the material on the strip edges sufficiently to accomplish the desired passivation along the longitudinal edges. Deformation of the workpieces by slitting is shown in FIGS. 7 and 8.

The strips S' produced in the slitting apparatus are subsequently subdivided into small, completely passivated pieces or compacts 62 which can be handled, stored and shipped in bulk without degradation, using only conventional equipment. The outer surface of each compact must be highly densified to achieve complete passivation. Since the center of the strip is less dense than the strip surface, the dividing process must sufficiently densify the newly created transverse surfaces to obtain complete passivation. The temperature of the strip at this point in processing is sufficiently high to maintain the iron strip in a highly malleable condition, particularly since the strip density is only about 70 to 80% of its theoretical density.

An alternative method of achieving simultaneous division and densification of passivated pieces of material is high speed cutting in which so much energy is introduced locally that the resulting heat melts a thin layer of the metallic material. Solidification of the material forms a dense protective skin on the new surfaces.

Figure 9:
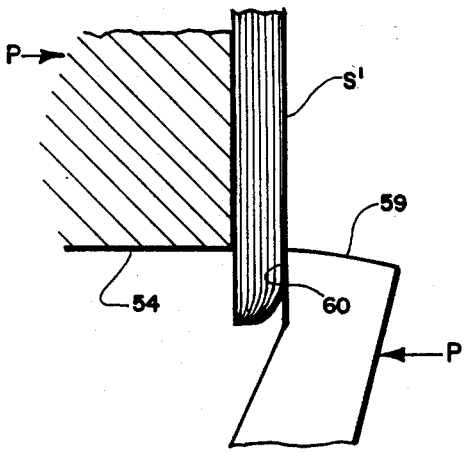
FIG. 9 is a schematic elevational view of a workpiece about to be sheared transversely.
Figure 10:
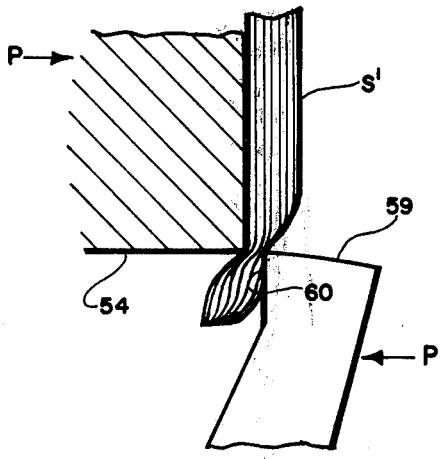
FIG. 10 is a schematic elevational view of a workpiece undergoing transverse shearing and concomitant densification of its sheared edges.

Simultaneous division and densification of the strip is accomplished by moving the strip past anvil 54 while driving blades 59 of rotary shear 56 against the strip. This action and the deformation of the sheared faces of the resulting compacts are shown in FIGS. 9 and 10. The stresses from deformation actually cause densification of that portion of the material comprising the sheared faces. In fact, hot shearing compresses the material at each face, rendering the sheared dimension less than that of the normal workpiece thickness.

If the compacts have been produced for shipment, they must be cooled to ambient temperature. Since the compacts are completely passivated cooling can be accomplished by quenching in or by water, or by any other available means. Suitable apparatus for water quenching has been illustrated in FIG. 1 and described above.

Figure 1B:
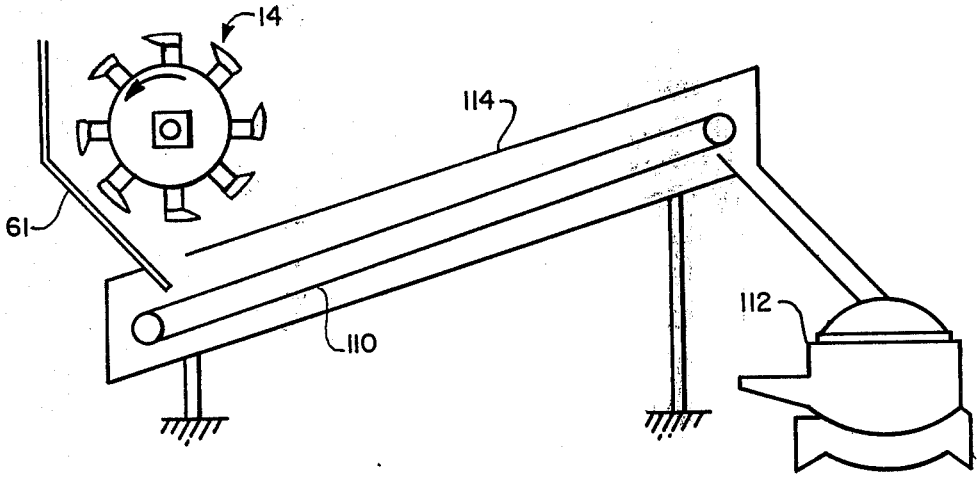
FIG. 1B is an elevational view of an alternative product discharge and delivery apparatus.

Upon shearing, the compacted products remain hot. If these compacts are to be used in an adjacent steel producing mill, the inherent heat in the compacts may be utilized to reduce the energy input required in the melt shop and increase productivity. To accomplish this, the compacts are transferred as shown in FIG. 1B without quenching or cooling to a heavy-duty steel apron conveyor 110 to be transported directly to a melting furnace 112. Since the conpacts are in a passivated condition, they can be transported with no special precautions in ambient air. It is desirable, however, to protect the compacts from cooling by wind, rain, snow, etc. Thus, the conveyor may be house in enclosure 114 to protect it from cooling effects of the elements, and the conveyor may be insulated to prevent heat loss from the compacts, particularly by convection. If waste gas is available having a temperature greater than 700° C from either the steel mill or from the direct reduction facility, this gas may be introduced to the enclosure surrounding the apron conveyor to minimize heat loss of the compacts during transport. Suitable gases are blast furnace gas, waste gas or spent reducing gas from a direct reduction furnace, off gas from a metal refining furnace such as an electric furnace, and gaseous hydrocarbns. It is preferable that the gas be non-oxidizing in character, but this is not necessary due to the passivation of the compacts.

In its simplest form, my method for continuously passivating a hot reactive particulate metal comprehends feeding the particulate metal 20 to a compacting apparatus such as compacting rolls 24 and 26, compacting the particulate metal material to form a dense elongated metal mass, followed by the simultaneous division of the elongated metal mass by cutting it across its longitudinal dimension by apparatus such as shear 56 and anvil 54, while simultaneously densifying the newly created surfaces caused by such cutting, thus producing a completely passivated product suitable for bulk handling, storing and shipping without additional passivating steps.

The iron compacts produced by this process have generally rectangular faces which form a substantially rectangular parallelepiped.

It is clear from the foregoing that I have overcome the difficulties of prior art practices and have invented an apparatus for passivating metallic materials which are highly reactive and readily subject to oxidation. I have provided a simplified and efficient method and apparatus for the passivation of sponge metal, the product of which has consistently high quality and which apparatus requires a minimum of maintenance. My passivating system produces a hot product that can be directly transported to a metal refining facility at the high temperature at which it completed the passivation process whereby the inherent heat content of the product will reduce the energy input required in the metal refining process and reduce the melting time. Alternatively the hot passivated product can be cooled for safe storage, handling and bulk shipment.

What is claimed is:

1. Apparatus for continuously passivating hot, reactive, particulate metal material comprising:

a. means for feeding said particulate metal material to a compacting apparatus, said feeding means including means for excluding substantially all atmospheric air therefrom;

b. means for compacting said particulate metal to form a dense elongated metal mass;

c. shearing means comprising two opposed cutting edges of metal coacting along a shear plane for simultaneously dividing said elongated metal mass substantially normal to its longitudinal dimension and densifying the newly created surface by induced high shear forces, whereby a completely passivated product is produced suitable for bulk handling, storing and shipping.

2. Apparatus according to claim 1 wherein said feed means includes means for controlling the rate of feed of said particulate material to said compacting means.

3. Apparatus according to claim 1 wherein said feed means is a hopper therefrom.

4. Apparatus according to claim 3 wherein said feed means is a gravity flow hopper.

5. Apparatus according to claim 1 wherein said compacting means is a pair of compression rolls.

6. Apparatus according to claim 5 wherein said compression rolls are horizontally opposed.

7. Apparatus according to claim 6 wherein said feed means includes a feed tongue for directing and controlling the amount of particulate metal material fed to the nip of the rolls.

8. Apparatus according to claim 2 wherein said means for controlling the rate of feed is a screw feeder.

9. Apparatus according to claim 1 wherein said shearing means comprises a stationary anvil and a shear knife mounted for angular rotation about a horizontal axis.

10. Apparatus according to claim 1 further comprising means for longitudinally cutting said mass while simultaneously passivating its newly cut edges immediately after said compacting apparatus.

11. Apparatus according to claim 10 wherein said longitudinal cutting means is a pair of horizontally opposed slitter rolls having opposed collars and recesses.

12. Apparatus according to claim 1 further comprising means for cooling said product to ambient temperature.

13. Apparatus according to claim 1 further comprising means for transporting said product at high temperatures directly to a metal refining furnace.

14. Apparatus according to claim 13 further comprising an enclosure around said transporting means.

15. Apparatus according to claim 14 wherein said enclosure is substantially gas-tight and includes means for introducing hot gases into the interior thereof to maintain the temperature of the hot product at least about 700° C.

* * * * *